United States Patent [19]

Crosby et al.

[11] 3,994,728

[45] Nov. 30, 1976

[54] FOG MONITOR

[75] Inventors: Robert J. Crosby, Wickliffe; Kenneth F. Karpinski, Seven Hills; David R. Schaller, Chagrin Falls, all of Ohio

[73] Assignee: Horizons Incorporated, a division of Horizons Research Incorporated, Cleveland, Ohio

[22] Filed: Feb. 24, 1975

[21] Appl. No.: 552,597

[52] U.S. Cl. ..... 96/48 R; 96/27 R; 96/45.2; 96/89; 96/90 R; 96/119 PQ

[51] Int. Cl.[2] ..... G03C 5/24

[58] Field of Search ..... 96/48 R, 27 R, 45.2, 96/119 PQ, 90 R, 89

[56] References Cited

UNITED STATES PATENTS

| | | | |
|---|---|---|---|
| 3,042,517 | 7/1962 | Wainer | 96/90 R |
| 3,573,046 | 3/1971 | Fotland et al. | 96/48 R |
| 3,618,504 | 11/1971 | Fotland | 96/45.2 |
| 3,658,533 | 4/1972 | Fotland et al. | 96/90 R |
| 3,732,098 | 5/1973 | Schmidt | 96/90 R |
| 3,764,334 | 10/1973 | Wainer et al. | 96/90 R |
| 3,794,491 | 2/1974 | Borsenberger et al. | 96/45.2 X |

*Primary Examiner*—Mayer Weinblatt
*Attorney, Agent, or Firm*—Lawrence I. Field

[57] ABSTRACT

A method for monitoring the optical development of non-silver free radical film in which the fog buildup in a selected non-image portion of the film is used to control the intensity and/or duration of the development exposure so as to insure a desired level of contrast between image and non-image areas in the developed film.

3 Claims, No Drawings

FOG MONITOR

This invention relates to improvements in the dry development of non-silver photosensitive films, e.g. as described in U.S. Pat. Nos. 3,510,300 issued May 5, 1970; 3,573,046 issued Mar. 30, 1971; 3,618,504 issued Nov. 9, 1971 and 3,732,098 and 3,731,612 both issued May 8, 1973 and in an article entitled "Red Light Development of Latent Images" published on pages 49 and 50 of Symposium III "Unconventional Photographic Systems" by the Society of Photographic Scientists and Engineers Washington, D.C. "Advance Printing of Invited Papers and Summaries".

As described in those patents, photosensitive films which have been exposed to a pattern of suitable radiation so as to produce a latent image in the film can be developed by blanket exposure to radiation of other wavelengths than that which produced the image.

The satisfactory practice of the procedures described in the above noted patents has been found to be complicated by the tendency of the film to fog in areas other than those bearing the desired image, whereby contrast between the image and the background is diminished by the presence of such fog.

The person who is developing the visible image is usually unaware of the previous history of the film and hence does not know the duration or extent of the latent image producing exposure, and is also uninformed as to the age, storage, etc. of the film. Since these may all affect the manner in which the film responds to the blanket exposure made for purposes of developing a visible image and fixing the film, it would be helpful to him to have some indication as to the development of fog in the unexposed (non-image) areas of the film, as a consequence of the blanket exposure.

The present invention is directed to a method and apparatus for providing to the individual performing the development of the film information concerning the generation of fog in the non-image areas, during the development exposure so that the development exposure can be halted before the background or fog becomes excessive.

The film utilized in the practice of the invention is conventionally slightly wider than the area which is exposed during the picture taking step. The present invention is predicated on the inspection of these unexposed, non-image borders of the film strip by suitable means which read the "fogging" of the film incidental to the optical development of the film and, which means may be caused to automatically terminate the development step when any previously selected value of base plus fog is reached in the non-image borders of the film strip.

In one mode of practicing this invention, the film to be monitored is positioned within an apparatus such as is described in above noted U.S. Pat. No. 3,573,046, and while it is being optically developed, a scan is made along the "unexposed" margins of the film, by traversing said margin with a recording spectrophotometer. Changes in the output signal are amplified and indicated on any suitable meter, e.g., a microammeter, which can be calibrated to indicate when the base plus fog has reached a significant level, selected to avoid a loss of contrast. A level of 0.3 density is one such level.

The invention is also applicable to film being developed while moving through an apparatus as described in U.S. Pat. No. 3,618,504, and is intended to be an improvement over the closed loop control system described in FIG. 6 of the patent.

In the present invention instead of exposing the edge strip of the film to a preselected density level, only the unexposed (non-image) regions are monitored for density increases, indicative of fog or background in the film.

The manner in which the fog level builds up is a function of the properties characteristic of any specific film and depends on the film composition and its history. The fog level is thus directly related to the actual photographic speed of the film, and can be used as the control by which long lengths of film can be processed regardless of variations in the photographic speed along the length of the film.

In the present invention both edges of the film are sensed and the increases in density are averaged so as to compensate for any non-uniformity which may exist across the width of the film.

In brief, an apparatus used in the practice of this invention in a stationary mode (film not moving) for one specific film composition consisted of a light emitting diode emitting at 665 nm and a photo transistor receptor. The film being monitored for fog buildup was introduced into the light path and the changes in output signal were amplified and indicated on a microammeter. This can be used in the apparatus of 3,573,046.

With a film moving continuously through an apparatus such as that shown in U.S. Pat. No. 3,618,504, a uniform light emission across the apparatus is obtained from a suitable array of light emitting diodes.

Since relatively little development occurs during the first part of the lighted path, it has not been found necessary to monitor the fog level in this part of the apparatus. Actually at relatively slow rates of film advance, the fog appears to be formed in the last 25 % of the development path through the apparatus.

When a sensor along the film path detects a premature fog buildup, the lamps used for development can be dimmed or even extinguished for the remainder of the film travel through the apparatus, until the sensor detects the cessation of premature fogging.

The films to which the present invention is applicable are compositions such as those described in patents issued to Eugene Wainer and others of his co-workers at Horizons Research Incorporated including the following:

3,042,517 issued July 9, 1962
3,620,748 issued Sept. 21, 1971
3,510,300 issued May 5, 1970 and others of a similar nature.

The illumination utilized for the development exposure depends to some extent on the film composition, e.g., as described in the above noted Paper published by the Society of Photographic Scientists and Engineers.

Having now described a preferred embodiment of the invention, it is not intended that it be limited except as may be required by the appended claims.

We claim:

1. A method of monitoring the optical development of non-silver free radical photosensitive films which comprises:

imagewise exposing said film to a dose of radiation to produce a latent image in said film, corresponding to an image, said image being such that a specific portion of said film is reserved to be a non-image area which has not been exposed to said radiation; thereafter subjecting said latent image bearing film to a blanket exposure of radiation to develop a visible image in the areas exposed to said dose of radiation and corresponding to said latent image; and monitoring the progressive development of fog in said specific portion of said film which has not been exposed to said dose of radiation by means which detect the fog level in said specific portion of said film as it increases, while said film is being subjected to said blanket exposure of radiation; and terminating said blanket exposure when the fog level in said specific portion of said film reserved to be a non-image area reaches a selected level whereby the desired contrast between image and non-image areas is obtained.

2. The method of claim 1 wherein said selected portion is a narrow strip along an edge of said film.

3. The method of claim 3 wherein the amount of radiation passing through said strip is measured to determine the cut-off of said blanket exposure for optical development of said latent image to a visible image.

* * * * *